US010736425B2

(12) United States Patent
Zuo et al.

(10) Patent No.: US 10,736,425 B2
(45) Date of Patent: Aug. 11, 2020

(54) LIFTING SEATING DEVICE

(71) Applicant: UE FURNITURE CO., LTD, Zhejiang (CN)

(72) Inventors: Zonglei Zuo, Zhejiang (CN); Jun Cheng, Zhejiang (CN)

(73) Assignee: UE FURNITURE CO., LTD, Zhejiang (CN)

( * ) Notice: Subject to any disclaimer, the term of this patent is extended or adjusted under 35 U.S.C. 154(b) by 0 days.

(21) Appl. No.: 16/296,245

(22) Filed: Mar. 8, 2019

(65) Prior Publication Data

US 2019/0200765 A1 Jul. 4, 2019

Related U.S. Application Data

(63) Continuation of application No. PCT/CN2017/120415, filed on Dec. 30, 2017.

(30) Foreign Application Priority Data

Mar. 31, 2017 (CN) ..... 2017 1 0210585

(51) Int. Cl.
*A47C 3/30* (2006.01)
*A47C 3/20* (2006.01)
(Continued)

(52) U.S. Cl.
CPC ..... *A47C 3/30* (2013.01); *A47C 3/16* (2013.01); *A47C 3/18* (2013.01); *A47C 3/20* (2013.01); *A47C 7/004* (2013.01); *A47C 7/18* (2013.01)

(58) Field of Classification Search
CPC .... A47C 3/20; A47C 3/32; A47C 3/30; A47C 3/40; A47B 9/10; A47B 9/12; A47B 9/20
See application file for complete search history.

(56) References Cited

U.S. PATENT DOCUMENTS

D118,295 S * 12/1939 Tropauer ..... D6/349
2,742,953 A * 4/1956 Kudrna ..... A47C 3/24 248/405

(Continued)

FOREIGN PATENT DOCUMENTS

CN 86209065 2/1988
CN 2305108 1/1999

(Continued)

*Primary Examiner* — Timothy J Brindley
(74) *Attorney, Agent, or Firm* — JCIPRNET

(57) ABSTRACT

The present invention relates to a lifting seating device, including a seat assembly, a lifting assembly and a base assembly which can be placed on the ground. A lower end of the lifting assembly is mounted to the base assembly, and an upper end of the lifting assembly is connected to the seat assembly. The lifting seating device further includes an elastic shielding cover arranged to circle a side surface of the lifting seating device. Upper and lower ends of the elastic shielding cover are respectively coupled to the seat assembly and the base assembly. The elastic shielding cover extends and retracts with the lifting of the seat assembly under the action of the lifting assembly. The lifting assembly is arranged between the seat assembly and the base assembly, the elastic shielding cover is arranged, and upper and lower ends of the elastic shielding cover are respectively coupled to the seat assembly and the base assembly. Thus, the base assembly and the lifting assembly are covered by the elastic shielding cover to achieve a simple and attractive appearance. Meanwhile, the elastic shielding cover extends and retracts with the lifting of the seat assembly under the action of the lifting assembly, so that a chair also has a lifting function.

19 Claims, 6 Drawing Sheets

(51) Int. Cl.

| | |
|---|---|
| ***A47C 3/18*** | (2006.01) |
| ***A47C 7/00*** | (2006.01) |
| ***A47C 3/16*** | (2006.01) |
| *A47C 7/18* | (2006.01) |

(56) References Cited

U.S. PATENT DOCUMENTS

| | | | | | |
|---|---|---|---|---|---|
| 3,522,925 | A * | 8/1970 | Buchtel | A61G 15/02 | 248/371 |
| 4,046,348 | A * | 9/1977 | Goodwin | A47C 3/40 | 248/423 |
| D263,012 | S * | 2/1982 | Hanaford | D6/708 | |
| 4,688,760 | A * | 8/1987 | Garman | A47C 3/30 | 254/122 |
| 4,778,216 | A * | 10/1988 | Stupakis | A47C 3/40 | 248/157 |
| 8,733,844 | B1 * | 5/2014 | Widmer | B64D 11/0619 | 297/452.41 |
| D739,111 | S * | 9/2015 | Arrindell | D34/31 | |
| 9,138,058 | B2 * | 9/2015 | Koolhaas | A47C 3/16 | |
| 2011/0109141 | A1 | 5/2011 | Molnar | | |
| 2013/0320727 | A1 * | 12/2013 | Martin | A47C 3/029 | 297/270.1 |

FOREIGN PATENT DOCUMENTS

| | | |
|---|---|---|
| CN | 2765523 | 3/2006 |
| CN | 203314496 | 12/2013 |
| CN | 107048792 | 8/2017 |

* cited by examiner

LIFTING SEATING DEVICE

CROSS-REFERENCE TO RELATED APPLICATION

This application is a continuation of international PCT application serial no. PCT/CN2017/120415, filed on Dec. 30, 2017, which claims the priority benefit of China application no. 201710210585.3, filed on Mar. 31, 2017. The entirety of each of the above-mentioned patent applications is hereby incorporated by reference herein and made a part of this specification.

BACKGROUND OF THE INVENTION

1. Field of the Invention

The present invention relates to a seating device and in particular relates to a lifting seating device.

2. Description of Related Art

A lifting chair is mainly composed of a seat, a base, a lifting locating device and a chair leg. The seat of the lifting chair is capable of lifting or lowering so that it is convenient for persons with different body heights to sit or stand. However, the lifting chair is relatively complex in structure and fails to have a simple and attractive appearance.

A pier chair is a type of chair which is popular in the modern market and is favored by the general public because of the simple and attractive appearance. However, the pier chair in the market does not has a lifting function, and persons with different body heights need different pier chairs, so that the pier chair provides a low applicability.

For the defects of the lifting chair and the pier chair in the current market, a novel lifting seating device which has the lifting function while having the simple and attractive appearance as the pier chair is provided herein.

SUMMARY OF THE INVENTION

In order to solve the problem, the present invention is directed to a lifting seating device which has a simple and attractive appearance and also has a lifting function.

In order to achieve the aim, the present invention adopts the technical scheme as follows.

The lifting seating device includes a seat assembly, a lifting assembly and a base assembly which can be placed on the ground. A lower end of the lifting assembly is mounted to the base assembly, and an upper end of the lifting assembly is connected to the seat assembly. The lifting seating device further includes an elastic shielding cover arranged to circle a side surface of the lifting seating device. Upper and lower ends of the elastic shielding cover are respectively coupled to the seat assembly and the base assembly, and the elastic shielding cover extends and extracts with the lifting of the seat assembly under the action of the lifting assembly. The elastic shielding cover is always in a tensioned state when extending and extracting with the lifting of the seat assembly so that a middle portion of a circular side surface constructed by the elastic shielding cover forms a narrow waist part which is recessed inwards.

The lifting assembly is arranged between the seat assembly and the base assembly, the elastic shielding cover is arranged in a manner that the upper and lower ends of the elastic shielding cover are respectively coupled to the seat assembly and the base assembly, such that the base assembly and the lifting assembly are covered by the elastic shielding cover to achieve a simple and attractive appearance; and meanwhile, the elastic shielding cover extends and extracts with the lifting of the seat assembly under the action of the lifting assembly, so that the chair also has the lifting function. Furthermore, when being seen in a vertical direction, the diameters of the upper and lower parts are larger than the diameter of the middle part, and such configuration maintains during lifting and lowering the seat assembly 300, so that the overall appearance is attractive.

The lifting seating device adopting the technical scheme has the following advantages.

1. The lifting assembly is arranged between the seat assembly and the base assembly, the elastic shielding cover is arranged in a manner that the upper and lower ends of the elastic shielding cover are respectively coupled to the seat assembly and the base assembly, such that the base assembly and the lifting assembly are covered by the elastic shielding cover to achieve a simple and attractive appearance; and meanwhile, the elastic shielding cover extends and extracts with the lifting of the seat assembly under the action of the lifting assembly, so that the chair also has the lifting function.

2. Due to the arrangement of a rotating mechanism, the seat assembly and the elastic shielding cover are able to rotate for 360°.

3. Due to the arrangement of the elastic sleeve, the lifting assembly is subjected to an elastic restoring force during regulating the sitting posture, and the elastic sleeve is able to be compressed and deformed, so that the lifting seating device has a function of regulating the sitting posture.

DESCRIPTION OF THE EMBODIMENTS

The patent is further described below in combination with the accompanying drawings.

Embodiment 1

Figure 1:
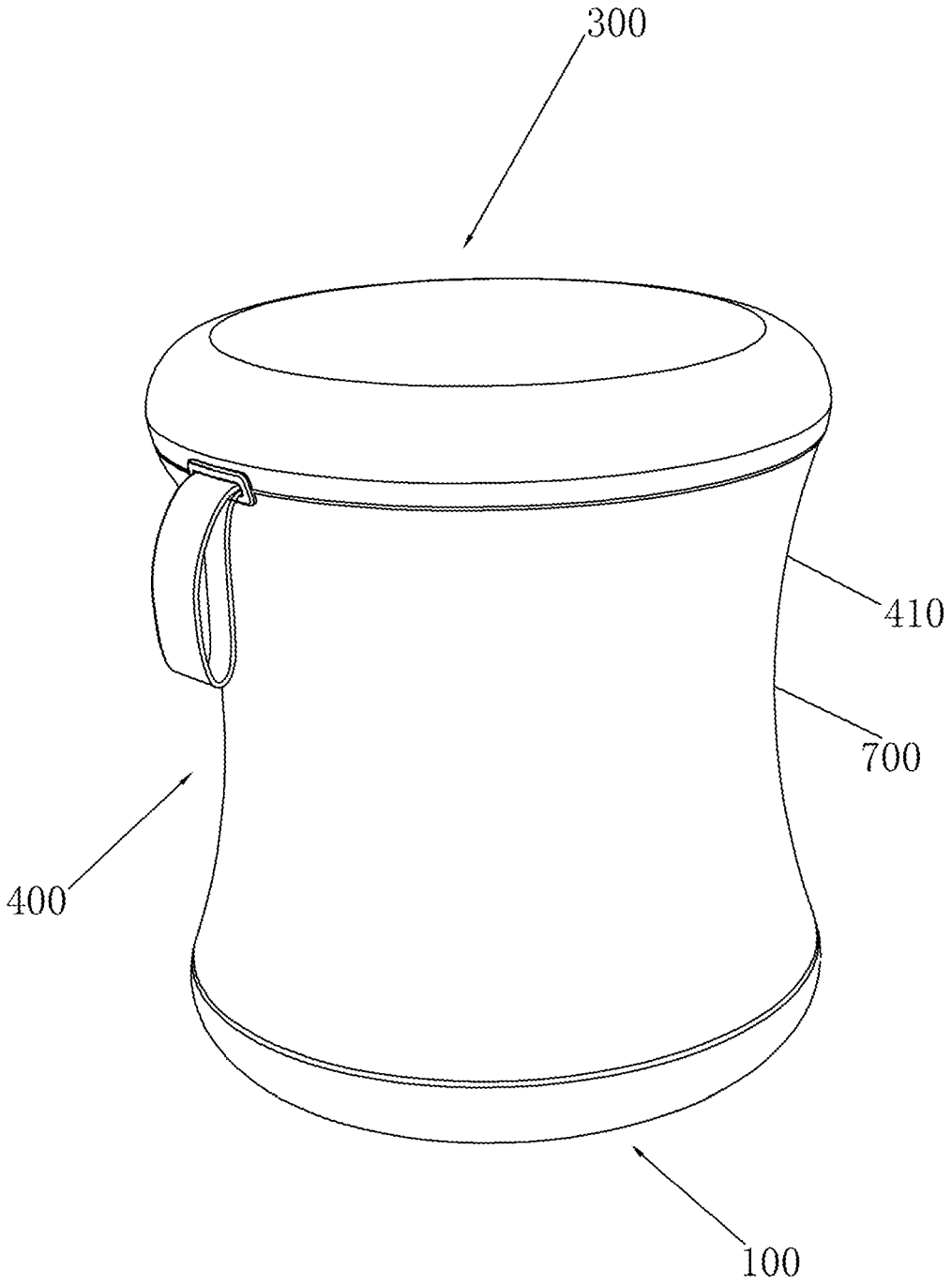
FIG. 1 is an external view of a lifting seating device in an embodiment.
Figure 2:
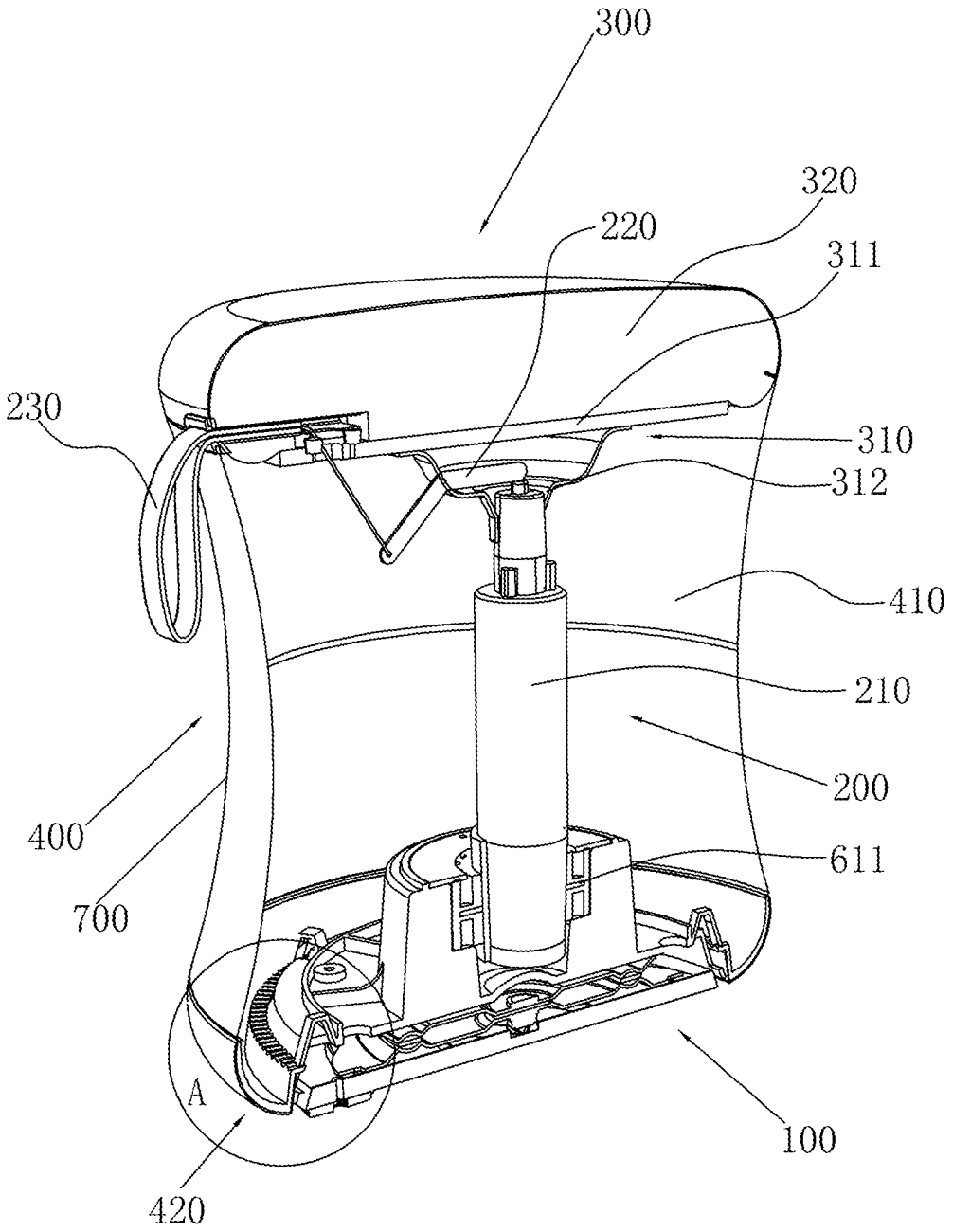
FIG. 2 is a cross-sectional side view of a lifting seating device in an embodiment.
Figure 3:
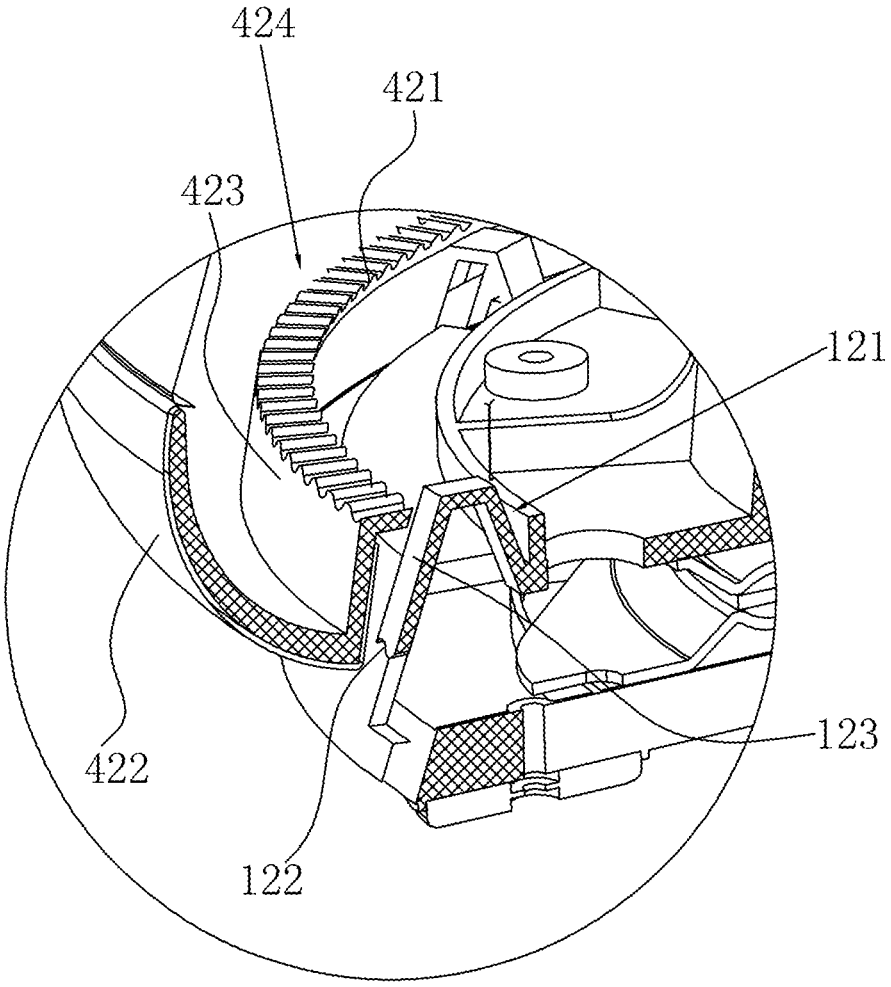
FIG. 3 is an enlarged view of the portion A in FIG. 2.

A lifting seating device as shown in FIG. 1 to FIG. 2 includes a base assembly 100, a lifting assembly 200, a seat assembly 300 and an elastic shielding cover 400. When the lifting seating device is used, the base assembly 100 is placed on the ground, a lower end of the lifting assembly 200 is mounted to the base assembly 100, an upper end of the lifting assembly 200 is connected to the seat assembly 300, the elastic shielding cover 400 is arranged to construct a circular side surface of the lifting seating device, and the elastic shielding cover 400 extends and extracts with the lifting of the seat assembly 300 under the action of the lifting assembly 200. The lifting assembly 200 is arranged between the seat assembly 300 and the base assembly 100, and the elastic shielding cover 400 is arranged in a manner that upper and lower ends of the elastic shielding cover 400 are respectively coupled to the seat assembly 300 and the base assembly 100, such that the base assembly 100 and the lifting assembly 200 are covered by the elastic shielding cover 400 so as to achieve a simple and attractive appearance. Meanwhile, the elastic shielding cover 400 extends and extracts with the lifting of the seat assembly 300 under the action of the lifting assembly 200, so that the chair (the lifting seating device) also has a lifting function.

An overall shape of each of the seat assembly 300 and the base assembly 100 is a round shape, and the diameters of the upper and lower parts of the lifting seating device are larger than the diameter of the middle part of the lifting seating device; the lowest height of the lifting seating device is 35 cm to 45 cm so that the lifting seating device can be suitable for children; and for young and middle-aged people and adults, the overall operational height of the lifting seating device is 35-65 cm, and is preferably 50-60 cm.

Figure 7:
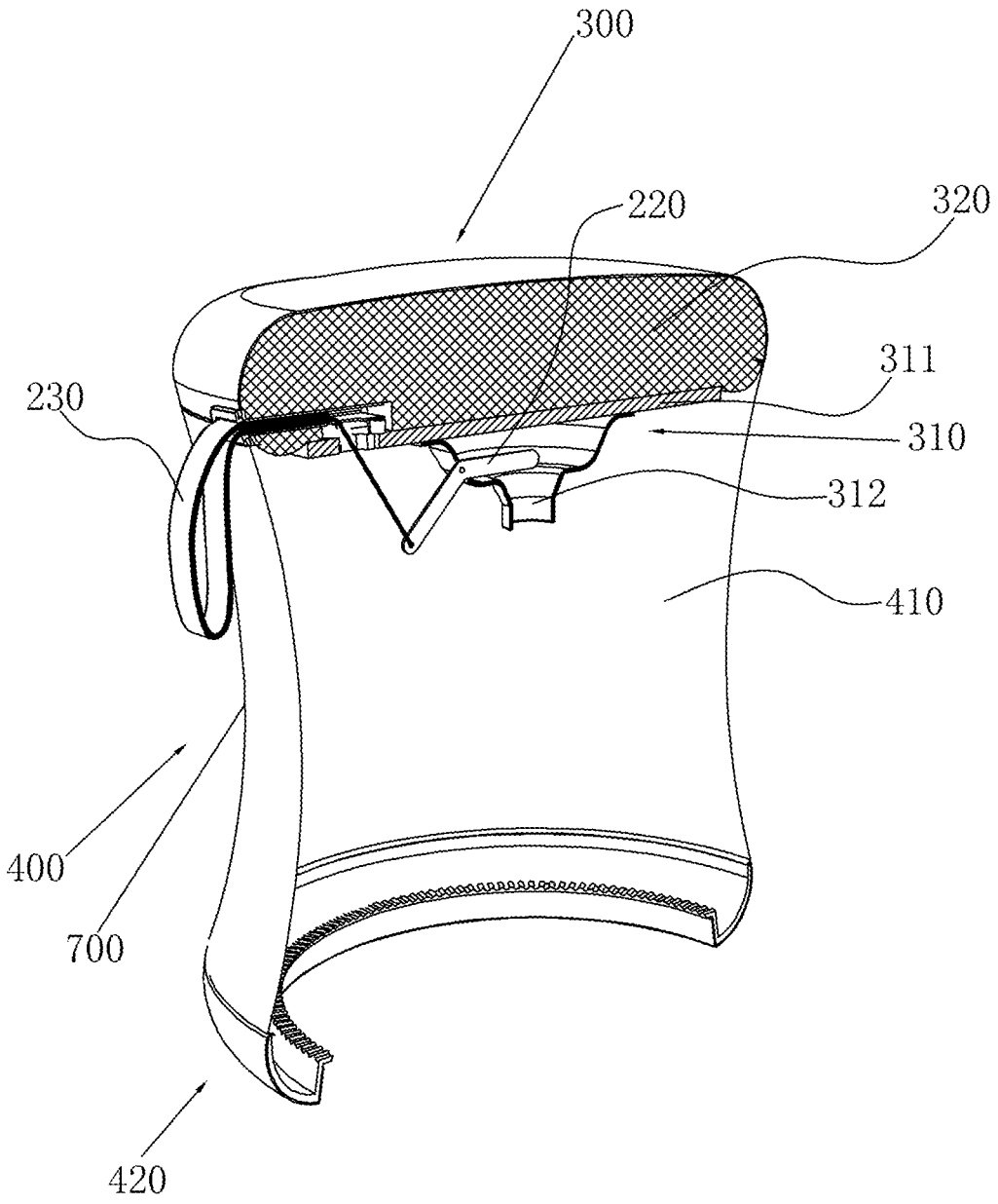
FIG. 7 is a schematic view showing the structure of the seat assembly and the elastic shielding cover.

As shown in FIG. 1, FIG. 2 and FIG. 7, the elastic shielding cover 400 is always in a tensioned state when extending and extracting with the lifting of the seat assembly 300 so that the middle portion of the circular side surface constructed by the elastic shielding cover 400 forms a narrow waist part 700 which is recessed inwards.

The elastic shielding cover 400 includes a cylindrical body 410 made of an elastic fabric and a connecting piece 420 arranged at the lower end of the cylindrical body 410, the lower end of the cylindrical body 410 is coupled to the base assembly 100 by using the connecting piece 420, the upper end of the cylindrical body 410 can be sewn on the side surface of the seat assembly 300, or the upper end of the cylindrical body 410 is provided with a cloth cover, and the cylindrical body 410 covers the seat assembly 300 through the cloth cover and downwards extends as a whole. Specifically, the middle portion of the circular side surface constructed by the cylindrical body 410 forms the narrow waist part 700 which is recessed inwards; the connecting piece 420 includes an arc-shaped holding part 422 gradually recessed inwards from the top to bottom and being at the outer side, a supporting part 423 arranged vertically or obliquely and being at the inner side and a snap tooth part 424 arranged at the upper end of the supporting part 423, the snap tooth part 424 is provided with second snap teeth 421, and a certain space is reserved between the holding part 422 and the supporting part 423. The shape of the holding part 422 facilitates hand holding during the mounting process, certain space is reserved between the holding part 422 and the supporting part 423 since the elastic fabric applies an inward component force to the upper end of the holding part 422 during lifting the lifting seating device, and the space can provide a sufficient space allowing the holding part 422 to inwards deform.

As shown in FIG. 2 to FIG. 6, an outer edge of the lower end of the base assembly 100 is provided with a plurality of undercuts 121, and the number of the undercuts is preferably 6. The undercut 121 includes a fastening part 123 which is obliquely and downwards arranged along the outer side of the base assembly 100, the fastening part 123 is an elastic element and can be inwards squeezed, and the lower end of the fastening part 123 is provided with first snap teeth 122. The base assembly 100 is further provided with an accommodating groove 124 for accommodating the fastening part 123 when the fastening part 123 is inwards squeezed.

An assembly process of the elastic shielding cover 400 and the base assembly 100 is as follows: a user holds the holding part 422 and downwards pulls the holding part 422 so that the connecting piece 420 leans against the outer inclined planes of the fastening parts 123, the fastening parts 123 are continuously squeezed inwards, and the fastening parts 123 are popped and are restored to the original position after the connecting piece 420 is mounted in place. At the moment, the first snap teeth 122 on the fastening parts 123 are firmly engaged with the second snap teeth 421 on the connecting piece 420 under the elastic restoring force of the cylindrical body 410 made of the elastic fabric, so that the movement of the connecting piece 420 in an axial direction is effectively limited, and the connecting piece 420 and the base assembly 100 are kept static or synchronously rotate; and by such connection, the characteristics of the elastic fabric are sufficiently utilized, the structure is simple, the mounting is rapid, and the movement of the connecting piece 420 in the axial direction is effectively limited.

The supporting part 423 is made of a material which has no elasticity and is incapable of being compressed and deformed. The supporting part 423 is made of the material not deformable after the connecting piece 420 is mounted and the fastening parts 123 are popped and restored to the original positions, and thus, the connecting piece 420 cannot be detached, and the service life of the connecting piece 420 is very long.

Figure 4:
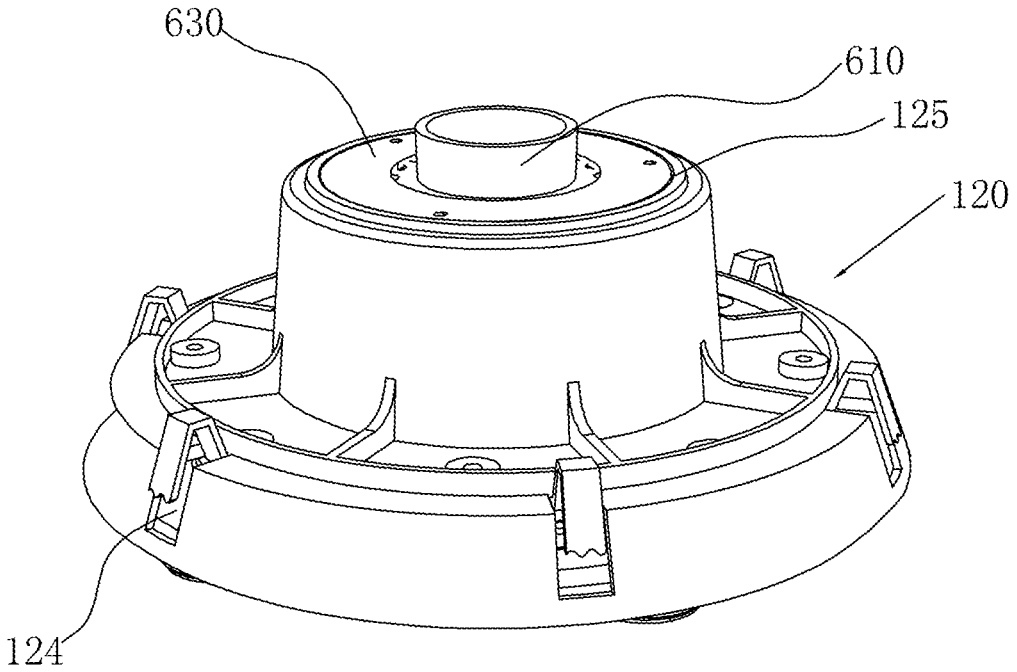
FIG. 4 is a schematic view showing the structure of the base assembly in an embodiment.
Figure 5:
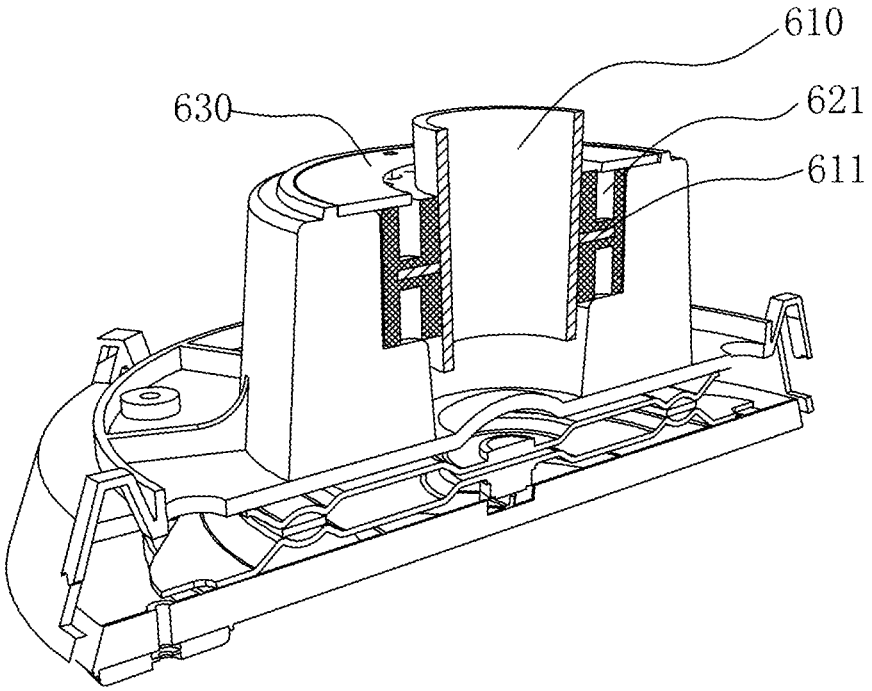
FIG. 5 is a cross-sectional side view of the base assembly in an embodiment.
Figure 6:
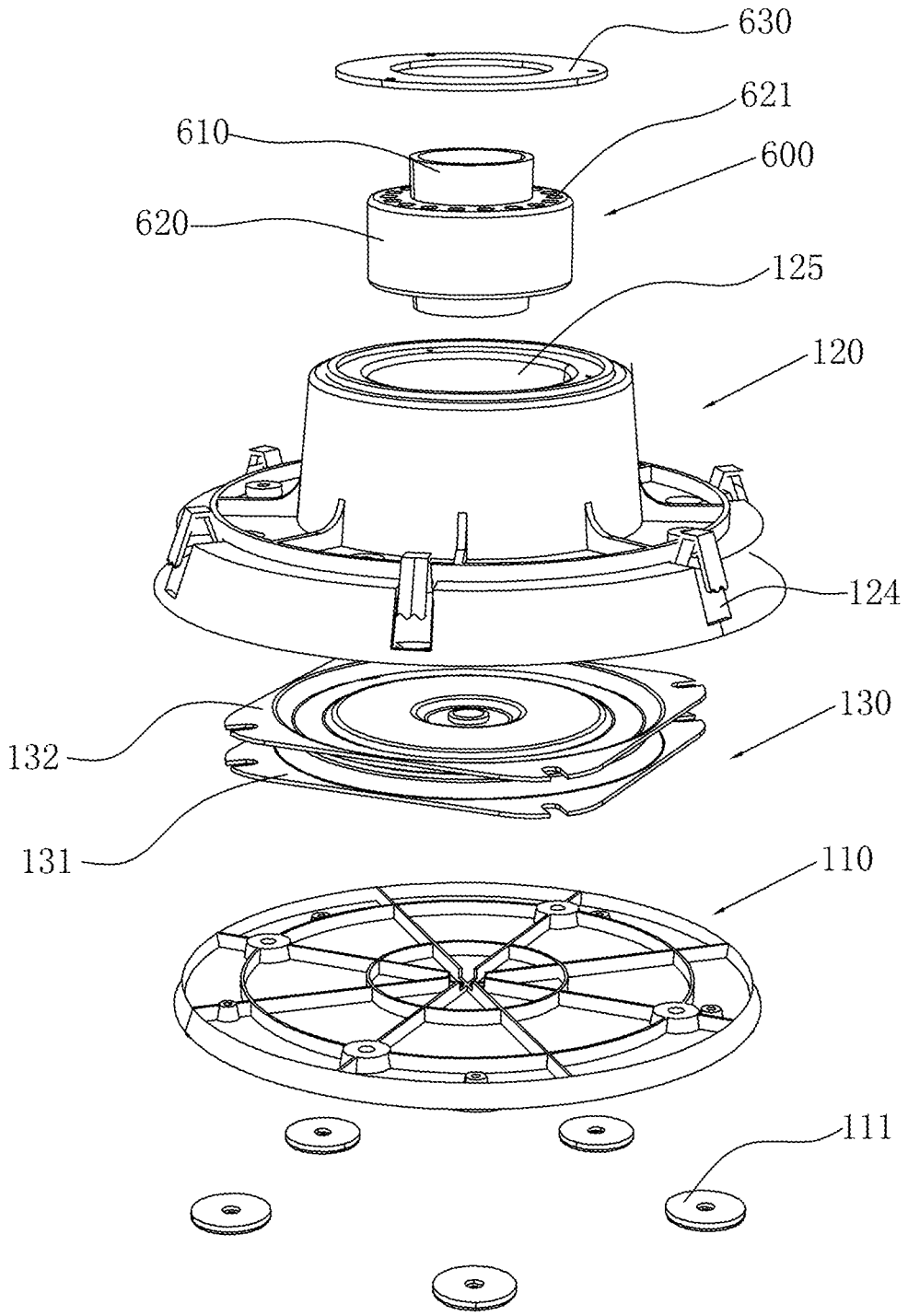
FIG. 6 is an explored view of the base assembly in an embodiment.

As shown in FIG. 4 to FIG. 6, the base assembly 100 includes a lower base 110 and an upper base 120 capable of rotating around the lower base 110. In order to reduce friction, the lower end of the lower base is provided with five foot pins 111 which are distributed in a regular pentagon. Furthermore, a rotating mechanism 130 is arranged between the upper base 120 and the lower base 110, the rotating mechanism 130 includes a base disk 131 and a rotating disk 132 pivoted to the base disk 131, and the undercuts 121 are arranged on a lower edge of the upper base 120. In order to save the material, the rotating disk 132 is arranged as a square disk. Due to the arrangement of the rotating mechanism 130, the seat assembly 300 and the elastic shielding cover 400 are able to rotate for 360°.

The center of the upper base 120 is provided with a mounting cavity 125, and a taper sleeve assembly 600 is arranged in the mounting cavity 125. The taper sleeve assembly 600 includes a first pneumatic rod taper sleeve 610 and an elastic sleeve 620 wrapping the first pneumatic rod taper sleeve 610, and the elastic sleeve 620 is in interference fit with the mounting cavity 125. The outer side of the first pneumatic rod taper sleeve 610 is further sleeved with a rubber pressing plate 630, and the rubber pressing plate 630 clings to the upper end surface of the elastic sleeve 620. The outer side of the first pneumatic rod taper sleeve 610 is integrally provided with a fixing ring 611, and the fixing ring 611 is embedded into the elastic sleeve 620 after the first pneumatic rod taper sleeve 610 and the elastic sleeve 620 are assembled. A plurality of holes 621 each extending in a vertical direction is formed in the elastic sleeve 620. By the arrangement of the elastic sleeve 620, the lifting assembly 200 is subjected to an elastic restoring force during a user regulates the sitting posture, and the elastic sleeve 620 is able to be compressed and deformed, so that the lifting seating device has a function of regulating the sitting posture. By the arrangement of the holes 621 each extending in the vertical direction, the elastic sleeve 620 has a sufficient compression space during the lifting assembly 200 is regulated on all sides, so that the operational regulating range is greatly widened. The elastic sleeve 620 may be formed integrally or two elastic sleeves 620 may be included. When two elastic sleeves 620 are included, the fixing ring 611 is assembled between the two elastic sleeves 620.

As shown in FIG. 2 and FIG. 7, the seat assembly 300 includes a base plate 310 and a soft cushion 320 arranged on the base plate. The base plate 310 includes a bottom plate 311 and a second pneumatic rod taper sleeve 312 arranged at the center of the lower end surface of the bottom plate 311. The second pneumatic rod taper sleeve 312 is funnel-shaped and the lower end thereof is a funnel spout.

As shown in FIG. 2, the lifting assembly 200 includes a lifting pneumatic rod 210, an L-shaped control panel 220 and a drawstring 230, one end of the drawstring 230 is connected to the L-shaped control panel 220, and the other end of the drawstring 230 penetrates through the cylindrical body 410 to be exposed to the outer side of the lifting seating device. One end of the L-shaped control panel 220 is connected to the drawstring 230, and the other end of the L-shaped control panel 220 is connected to an on-off button of the lifting pneumatic rod 210. The lower end of the lifting pneumatic rod 210 is inserted into the first pneumatic rod taper sleeve 610 in an interference way and keeps a relative static state inside the first pneumatic rod taper sleeve 610, and the upper end of the lifting pneumatic rod 210 is inserted into the funnel nozzle of the second pneumatic rod taper sleeve 312 in an interference way and keeps a relative static state inside the second pneumatic rod taper sleeve 312. When the height of the lifting seating device is required to be regulated, the drawstring 230 is pulled to drive the L-shaped control panel 220 to be in contact with the on-off button of the lifting pneumatic rod 210. In this case, the height is regulated by the lifting pneumatic rod 210. The height can be regulated by lifting the seat assembly 300 or lowering the seat assembly 300, and the height is fixed after the drawstring 230 is released.

Embodiment 2

A distinguishing technical feature of the present embodiment over Embodiment 1 is that the connecting piece 420 (including the supporting part 423) is made of the material which has elasticity and is able to be compressed and deformed. The supporting part 423 made of the material can deform after the connecting piece 420 is mounted and the fastening parts 123 are popped and restored to the original positions. Thus, the connecting piece 420 is detachable; however, the connecting piece 420 may be damaged in a detaching process, and therefore, the situation that the connecting piece 420 is loosened and fails to match the fastening parts 123 may occur after a long time.

Embodiment 3

A distinguishing technical feature of the present embodiment over Embodiment 2 is that the fastening parts 123 are vertically arranged and stretching downwards along the outer side of the base assembly 100, and the fastening parts 123 may be made of an elastic and compressible material or a nonelastic and incompressible material.

An assembly process of the elastic shielding cover 400 and the base assembly 100 is as follows: a user holds the holding part 422 and downwards pulls the holding part 422, the connecting piece 420 is outwards stretched after the holding part 422 is downwards pulled in place so that the lower end of the connecting piece 420 may pass through the fastening parts 123, and a force for pulling the connecting piece 420 is released after the connecting piece 420 is downwards pulled under the fastening parts 123. At the moment, the connecting piece is restored, and after a downward force applied to the connecting piece is released, the first snap teeth 122 on the fastening parts 123 are firmly engaged with the second snap teeth 421 on the connecting piece 420 under an elastic restoring force of the cylindrical body 410 made of the elastic fabric.

Embodiment 4

A distinguishing technical feature of the present embodiment over Embodiment 3 is that the connecting piece 420 is an elastic ring, and the lower end of the fastening part 123 is not provided with the first snap teeth 122.

The embodiments are only exemplary embodiments of this patent, where Embodiment 1 is an embodiment in which the optimal effect is achieved. The embodiments are not intended to limit the present invention, and any modifications, equivalent replacements, improvements and the like made within the spirit and principle of the present invention should fall into the scope of the present invention.

What is claimed is:

1. A lifting seating device, comprising a seat assembly, a lifting assembly and a base assembly placed on a ground, a lower end of the lifting assembly being mounted to the base assembly, and an upper end of the lifting assembly being connected to the seat assembly, wherein the lifting seating device further comprises an elastic shielding cover arranged to construct a circular side surface of the lifting seating device, upper and lower ends of the elastic shielding cover are respectively coupled to the seat assembly and the base assembly, and the elastic shielding cover extends and retracts with a lifting of the seat assembly under an action of the lifting assembly; and the elastic shielding cover is always in a tensioned state when extending and retracting with the lifting of the seat assembly so that a middle portion of the circular side surface constructed by the elastic shielding cover forms a narrow waist part (700) recessed inwards.

2. The lifting seating device according to claim 1, wherein the elastic shielding cover is made of one or more of an elastic rubber, an elastic plastic, an elastic fiber and an elastic fabric.

3. The lifting seating device according to claim 1, wherein an overall shape of each of the seat assembly and the base assembly is a round shape, and the diameters of upper and lower parts of the lifting seating device are larger than the diameter of a middle part of the lifting seating device; and the lowest height of the lifting seating device is 35 cm to 45 cm, and an overall operational height of the lifting seating device ranges from 35 cm to 65 cm.

4. The lifting seating device according to claim 1, wherein the elastic shielding cover comprises a cylindrical body and a connecting piece arranged at the lower end of the cylindrical body, and the cylindrical body is coupled to the base assembly by the connecting piece; and the cylindrical body is always in a tensioned state when extending and retracting with the lifting of the seat assembly so that the middle portion of the circular side surface constructed by the cylindrical body forms the narrow waist part recessed inwards.

5. The lifting seating device according to claim 4, wherein the cylindrical body is made of one or more of an elastic rubber, an elastic plastic, an elastic fiber and an elastic fabric.

6. The lifting seating device according to claim 4, wherein the upper end of the cylindrical body is sewn on a side surface of the seat assembly.

7. The lifting seating device according to claim 4, wherein the cylindrical body (410) covers the seat assembly (300) and downwards extends as a whole.

8. The lifting seating device according to claim 4, wherein an outer edge of the lower end of the base assembly is provided with a plurality of undercuts, and after the connecting piece and the base assembly are assembled, the connecting piece is butted with the undercuts under an elastic restoring force of the cylindrical body.

9. The lifting seating device according to claim 8, wherein the lower end of the undercut is provided with first snap teeth, the connecting piece is provided with second snap teeth, and the first snap teeth are engaged with the second snap teeth after the connecting piece is mounted on the base assembly.

10. The lifting seating device according to claim 9, wherein the undercut comprises a fastening part which is obliquely and downwards arranged along an outer side of the base assembly, and the fastening part is an elastic element and is able to be inwards squeezed.

11. The lifting seating device according to claim 4, wherein the connecting piece comprises an arc-shaped holding part at an outer side, a supporting part at an inner side and a snap tooth part, the arc-shaped holding part being gradually recessed inwards from the top to bottom, the supporting part being arranged vertically or obliquely, the snap tooth part being arranged at the upper end of the supporting part, and a space is reserved between the holding part and the supporting part.

12. The lifting seating device according to claim 1, wherein the base assembly comprises a lower base and an upper base capable of rotating around the lower base.

13. The lifting seating device according to claim 12, wherein a rotating mechanism is arranged between the upper base and the lower base, the rotating mechanism comprises a base disk and a rotating disk pivoted to the base disk, and the connecting piece is fixed on the upper base.

14. The lifting seating device according to claim 1, wherein the base assembly (100) comprises a lower base and an upper base, a center of the upper base is provided with a mounting cavity, a taper sleeve assembly is arranged in the mounting cavity, and the lower end of the lifting assembly is fixed in the taper sleeve assembly.

15. The lifting seating device according to claim 14, wherein the taper sleeve assembly comprises a first pneumatic rod taper sleeve and an elastic sleeve wrapping an outer side of the first pneumatic rod taper sleeve, the elastic sleeve is in interference fit with the mounting cavity, and the lower end of the lifting assembly is fixed in the first pneumatic rod taper sleeve.

16. The lifting seating device according to claim 15, wherein a fixing ring is provided integrally at the outer side of the first pneumatic rod taper sleeve, and the fixing ring is embedded into the elastic sleeve.

17. The lifting seating device according to claim 16, wherein the elastic sleeve is formed as an integer; or two elastic sleeves are included, and the fixing ring is located between the two elastic sleeves.

18. The lifting seating device according to claim 1, wherein the lifting assembly comprises a lifting pneumatic rod, an L-shaped control panel and a drawstring, one end of the drawstring is connected to the L-shaped control panel, and the other end of the drawstring (230) penetrates through the cylindrical body to be exposed to the outer side of the lifting seating device.

19. The lifting seating device according to claim 18, wherein the seat assembly comprises a base plate, a center of the base plate is provided with a second pneumatic rod taper sleeve, and the upper end of the lifting assembly is inserted into the second pneumatic rod taper sleeve in an interference way.

* * * * *